US007008217B2

(12) United States Patent
Jacobberger

(10) Patent No.: US 7,008,217 B2
(45) Date of Patent: Mar. 7, 2006

(54) SAFETY DEVICE FOR BOILER COMPRISING A TIME DELAY PROTECTED BY AN ELECTRONIC CIRCUIT

(75) Inventor: Charles Jacobberger, Storckensohn (FR)

(73) Assignee: ALSTOM Switzerland Ltd, Baden (CH)

( * ) Notice: Subject to any disclaimer, the term of this patent is extended or adjusted under 35 U.S.C. 154(b) by 0 days.

(21) Appl. No.: 10/482,307

(22) PCT Filed: May 17, 2002

(86) PCT No.: PCT/FR02/01676

§ 371 (c)(1),
(2), (4) Date: Jun. 4, 2004

(87) PCT Pub. No.: WO03/004936

PCT Pub. Date: Jan. 16, 2003

(65) Prior Publication Data

US 2004/0197720 A1 Oct. 7, 2004

(30) Foreign Application Priority Data

Jul. 6, 2001 (FR) ..... 01 08988

(51) Int. Cl.
*F23N 1/00* (2006.01)

(52) U.S. Cl. ..... 431/24; 431/6; 431/18; 431/25

(58) Field of Classification Search ..... 431/6, 431/18, 24, 25, 26, 281
See application file for complete search history.

(56) References Cited

U.S. PATENT DOCUMENTS 3,576,556 A * 4/1971 Sellors, Jr. ..... 340/579
3,958,126 A * 5/1976 Bryant ..... 250/554
4,101,258 A * 7/1978 Jacobsz ..... 431/26
4,268,884 A * 5/1981 Ford et al. ..... 361/22
4,298,334 A * 11/1981 Clark et al. ..... 431/24
4,303,383 A 12/1981 Black et al.
4,459,099 A * 7/1984 Grunden et al. ..... 431/27
4,518,345 A * 5/1985 Mueller et al. ..... 431/24
4,581,697 A * 4/1986 Jamieson et al. ..... 700/11
4,604,046 A * 8/1986 Mueller et al. ..... 431/2
5,307,050 A 4/1994 Patton et al.
5,506,569 A * 4/1996 Rowlette ..... 340/577
5,749,718 A * 5/1998 Berlincourt ..... 431/60
6,600,960 B1 * 7/2003 Keegan ..... 700/21

FOREIGN PATENT DOCUMENTS

DE 35 32 229 A 2/1987
DE 37 04 062 A 8/1988

* cited by examiner

*Primary Examiner*—Carl D. Price
(74) *Attorney, Agent, or Firm*—Sughrue Mion, PLLC

(57) ABSTRACT

A safety device for an industrial boiler (CHA) including electromechanical relays ($RE_n$, RS), which are connected in series in order to form an electromechanical safety chain (CH1), and at least one shunt relay ($RT_n$) which is normally open and mounted in parallel to one of the electromechanical relays ($RE_N$). The shunt relay is controlled by an automaton (AP1) so that it is closed during a time delay. The shunt relay ($RT_n$) is provided with a contact that is connected to an electronic circuit ($CE_n$) and said electronic circuit ($CE_n$) opens an electromechanical relay (RS) which is mounted in series in the safety chain when the shunt relay ($RT_n$) is closed for longer than the time delay. Given the arrangement, in the event of an automaton failure, the time delay is ensured by the electronic circuit so that a satisfactory level of safety is guaranteed in relation to the installation.

4 Claims, 4 Drawing Sheets

SAFETY DEVICE FOR BOILER COMPRISING A TIME DELAY PROTECTED BY AN ELECTRONIC CIRCUIT

The invention concerns a safety device for an industrial boiler comprising electromechanical relays connected in series to form an electromechanical safety chain and at least one shunt relay that is normally open and connected in parallel with one of said electromechanical relays, said shunt relay being controlled by an automatic controller so that it is closed during a time delay duration.

The invention applies in particular to industrial boilers comprising a gas burner for producing steam or superheated water, for example. These boilers are fitted with a safety device of the type indicated above that is located between one or more sensors and one or more actuators mounted on the boiler and triggers shutting down of the boiler via the actuators when at least one sensor detects a malfunction of the boiler. The fault may be an excess pressure, a low water level, or a problem with the burner flame. Each sensor is a pressure-sensitive switch, for example, which supplies an alternating electrical current at 230 volts to hold closed a corresponding electromechanical relay connected in series in the safety chain of the device. The safety chain is an electrical circuit comprising a plurality of electromechanical relays connected in series to form an electrical circuit that is closed in normal operation and opened on detection of a fault by a sensor. The actuators, which can be solenoid valves, for example, are designed to trigger shutting down of the boiler as soon as they are no longer supplied with current. The safety device therefore comprises a relay for each sensor that is held closed by the corresponding power supply current and supplies electrical power to the actuators when the safety chain is closed. In the event of a malfunction, one of the sensors ceases to supply its current, in order to open the safety chain, which disconnects the electrical power supply from the actuators in order to trigger shutting down of the boiler.

Some sensors are tested every day to verify that the sensor under test opens the corresponding relay in the event of a fault in the boiler. These tests are carried out during operation, and the corresponding relay must open, but without causing shutting down of the boiler. A normally open shunt relay is therefore connected in parallel with the relay corresponding to the sensor under test. The shunt relay is closed by an automatic controller for a predefined time delay so that the safety chain remains closed when the relay of the sensor is opened during the test. Testing a pressure-sensitive switch consists, for example, in temporarily closing a valve isolating a chamber containing the pressure-sensitive switch and increasing the pressure in the chamber to verify that the corresponding relay in the safety chain opens when the pressure in the chamber increases. On closing the isolating valve, the shunt relay is closed by the automatic controller for the duration of the time delay. The pressure increase causes the relay of the sensor to be opened, but the safety chain remains closed because the shunt relay is closed. The isolating valve is then opened to terminate the test by returning the chamber to a normal pressure. The return to a normal pressure in the environment of the sensor therefore closes the relay of the sensor. The time delay is then disarmed by the automatic controller, which commands opening of the shunt relay, which corresponds to a return to the original state preceding the test.

The time delays give rise to a problem in that they are managed only by the automatic controller. Consequently, a malfunction of the automatic controller can keep a shunt relay in the safety chain closed beyond the duration of the time delay. In this case the corresponding sensor is disabled since, if it detects a fault, the opening of its relay will not cause opening of the safety chain, because its shunt relay is closed. A malfunction of this kind is therefore not detected by the safety device, which constitutes a major hazard in terms of safe operation of the installation.

The object of the invention is to remedy these drawbacks.

To this end, the invention consists in a safety device for an industrial boiler, said device comprising electromechanical relays connected in series to form an electromechanical safety chain and at least one normally open shunt relay that is connected in parallel with one of said electromechanical relays and is controlled by an automatic controller so that it is closed for a time delay duration, which device is characterized in that said shunt relay has a contact connected to an electronic circuit and said electronic circuit controls opening of an electromechanical relay connected in series in the safety chain in the event of closure of said shunt relay for a duration exceeding said time delay duration.

With this kind of construction the time delay is managed by the electronic circuit and by the automatic controller to ensure a satisfactory level of safety of the installation.

In one particular embodiment of the invention a safety device for an industrial boiler comprises electromechanical relays connected in series to form an electrical power supply circuit of an actuator of the boiler and one of said relays being controlled by an automatic controller so that it is open for a time delay duration on receiving a time delay start instruction, which device is characterized in that an electronic circuit controls another electromechanical relay that is also connected in series in said power supply circuit and opens said other electromechanical relay for said time delay duration on receiving said time delay start instruction. With this arrangement, a minimum time delay duration, such as a minimum preliminary scavenging duration that must precede an entry into service, must also be secured.

In a preferred embodiment of the invention, the relay that is controlled by the electronic circuit is closed when it is supplied with electrical power by the electronic circuit and open otherwise. With this arrangement, in the event of a fault in the electronic circuit, the time delay duration tends toward zero so that the security chain is opened instantaneously in this event. This feature further improves the operating safety of the time delay management system.

In a preferred embodiment of the invention, the relays and said electronic circuit are mounted on a support in the form of a printed circuit board. With this arrangement, the safety device can be mounted in a compact system enclosed in a chamber that may be sealed to prevent an operative modifying its configuration.

In another particular embodiment of the invention, the electronic circuit comprises a PAL circuit. With this arrangement, the electronic circuit can be produced at lower cost.

The invention is described in more detail next with reference to the appended drawings, which show one embodiment of the invention by way of nonlimiting example.

Figure 1:
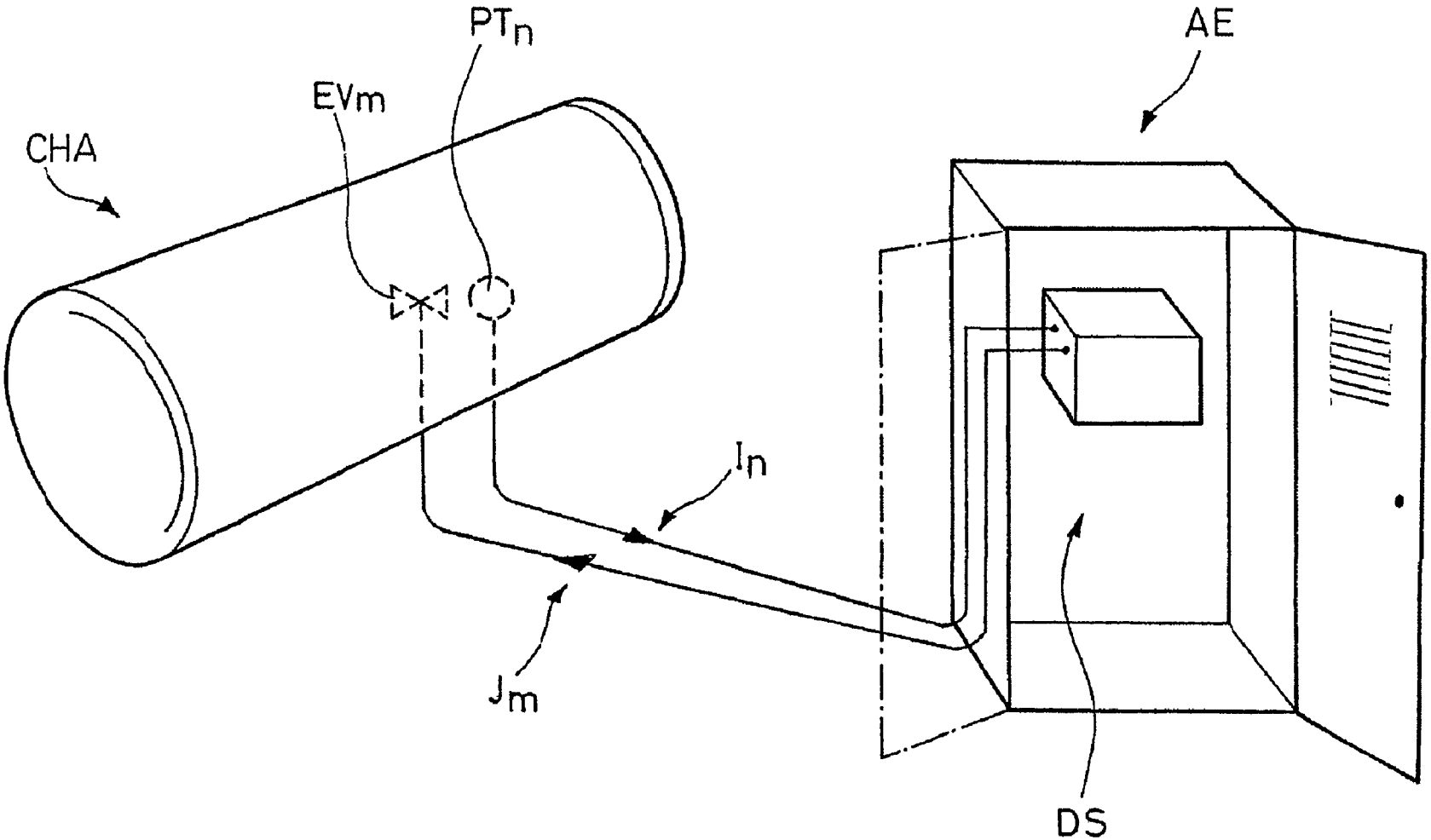
FIG. 1 is a highly diagrammatic depiction of the invention.

As depicted in FIG. 1, a safety device of the invention is connected to at least one sensor $PT_n$ and to at least one actuator $EV_m$. The sensor(s) and the actuator(s) are generally mounted in the industrial boiler CHA. The sensor $PT_n$, which in this example is a pressure-sensitive switch, sends an electrical current $I_n$ to the safety device DS, which in this example is mounted in an electrical equipment cabinet AE. When it receives the current $I_n$, the safety device sends a second electrical current $J_m$ to the actuator $EV_m$, which in this example is a solenoid valve, to maintain the actuator in a normal operating position. If the current $I_n$ is not received, the safety device DS commands a relay to open the electrical power supply circuit of the actuator $EV_m$ to cut off the current $J_m$ and thereby to trigger shutting down of the boiler. The electrical currents $I_n$ and $J_m$ are generally high-power alternating currents at 230 volts.

Figure 2:
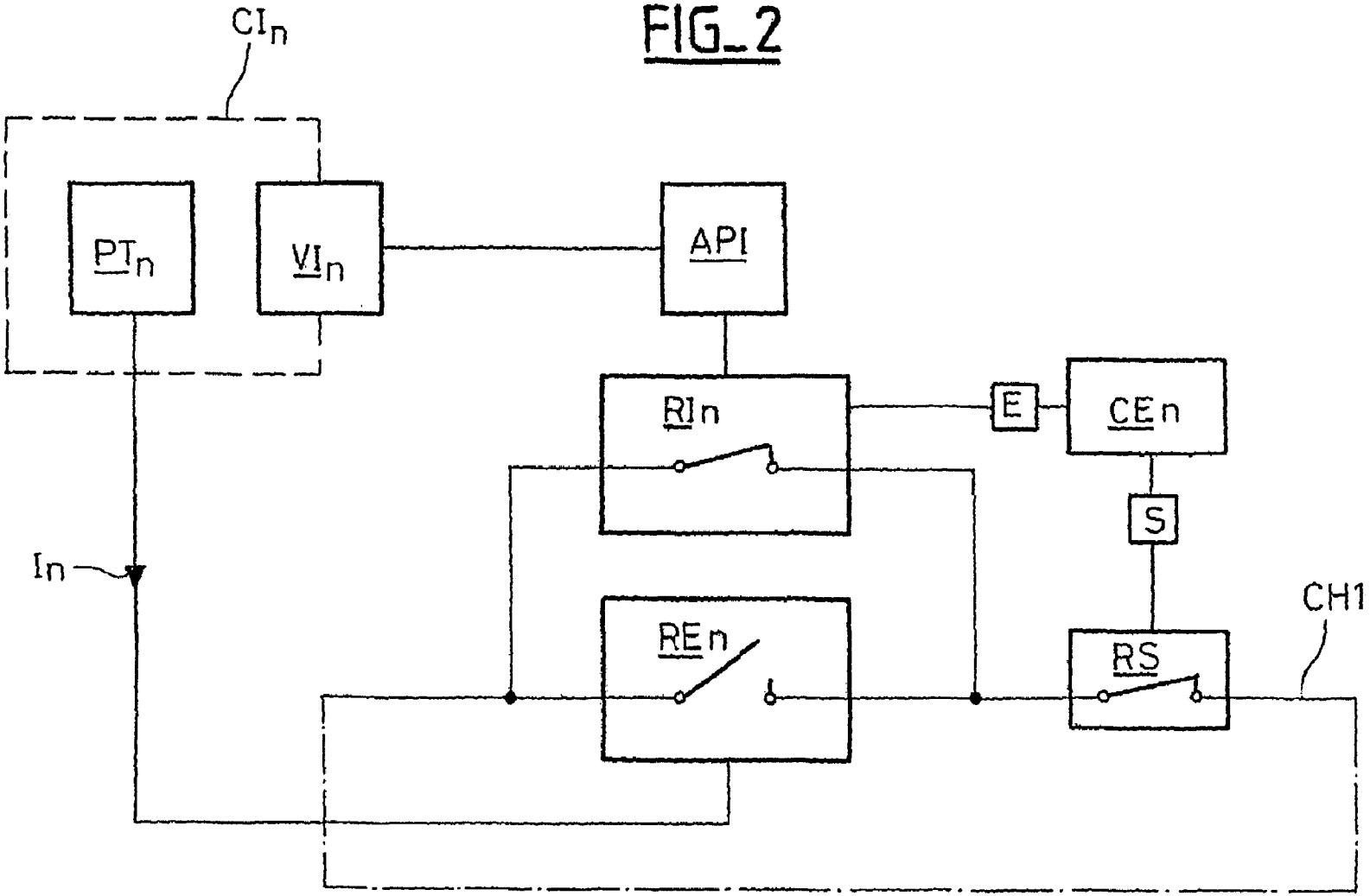
FIG. 2 is a highly diagrammatic depiction of a first embodiment of the invention.

FIG. 2 depicts highly diagrammatically the architecture of the safety device DS, which comprises a plurality of electromechanical relays $RE_n$ connected in series to form a safety chain CH1. Each relay $RE_n$ is held closed by a corresponding current $I_n$ supplied by a corresponding sensor $PT_n$. The safety chain CH1 thus constitutes an electrical circuit that is closed in normal operation and that is opened as soon as any of the sensors $PT_n$ detects a fault. To enable the sensors to be tested periodically, a normally open shunt relay $RT_n$ is connected in parallel with the relay $RE_n$ of the sensor. The shunt relay is controlled by an automatic controller API and is closed for a time delay duration starting from the beginning of the test. The time delay duration is 30 seconds maximum, for example. The test time delay starts when an operative tests a pressure-sensitive switch $PT_n$ by closing an isolating valve $VI_n$ of the corresponding isolating chamber $CI_n$ and increasing the pressure in that chamber. The isolating valve $VI_n$ is generally equipped with an electrical contactor connected to the automatic controller API to command the closing of the shunt relay $RT_n$ as soon as the valve $VI_n$ is closed. The shunt relay is then opened on the instructions of the automatic controller as soon as the time delay duration has elapsed. In the event of a malfunction of the automatic controller or the shunt relay $RT_n$, the shunt relay can remain closed for a duration exceeding the time delay duration. In this case, the corresponding sensor is disabled, since if it detects a fault opening its relay will not cause opening of the safety chain, because its shunt relay is closed. This kind of malfunction is therefore not detected by the safety device, which constitutes a major hazard for the operating safety of the installation.

According to the invention, the shunt relay $RT_n$ controlled by the automatic controller API has its time delay secured by an electronic circuit $CE_n$ that controls an electromechanical relay RS connected in series in the chain CH1 to open the chain CH1 if the relay $RE_n$ remains closed for a duration exceeding the time delay duration. The electronic circuit has an input E connected to a contact of the shunt relay $RT_n$ so that it triggers a time delay as soon as it detects closure of the relay $RT_n$; if the relay $RT_n$ is still closed at the end of the time delay, it commands opening of the relay RS. Thus the electronic circuit $CE_n$ is capable of triggering shutting down of the boiler independently of the automatic controller API and on detecting a duration exceeding the time delay duration. According to the invention, the time delay controlled by the automatic controller API is secured by the electronic circuit $CE_n$ to achieve heterogeneous hardware redundancy in respect of time delay management.

This embodiment is described by way of example for securing a time delay corresponding to a sensor test, but it can equally well be applied to securing other, similar time delays. For example, during a start-up sequence, a flame sensor is subject to a similar time delay in that it must detect the presence of a burner flame within at most five seconds from the start of supplying gas to the burner, failing which the boiler or its starter device must be made safe.

The circuit $CE_m$ can take various forms, for example using capacitors and resistors controlled by a logic integrated circuit to count the time delay duration on the basis of the time to charge a capacitor.

Figure 3:
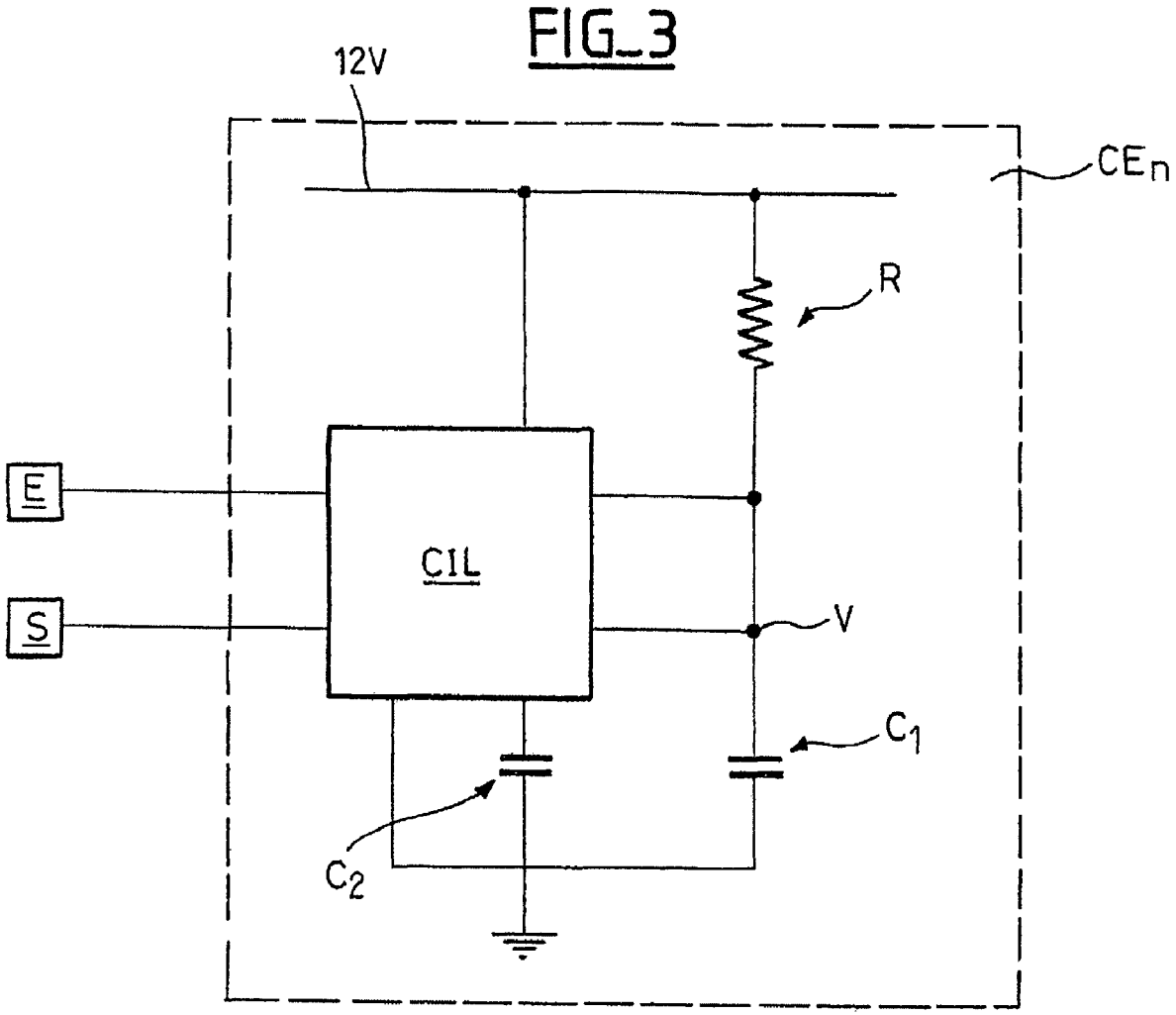
FIG. 3 is a highly diagrammatic depiction of an electronic circuit of the device of the invention.

FIG. 3 depicts highly diagrammatically one embodiment of the electronic circuit $CE_n$, which includes a logic integrated circuit CIL having an input E connected to a contact of the shunt relay $RT_n$ and an output S for commanding opening of the relay RS if the input E is supplied with power for a duration exceeding the time delay. The logic integrated circuit is connected to a 12 volt DC power supply and is also connected to a resistor R and to capacitors C1 and C2 for controlling the charging of the capacitor C1 to manage the time delay duration. On receiving at E an instruction to start the time delay, the logic integrated circuit initiates charging of the capacitor C1. The logic integrated circuit also has an input connected to a point V between the resistor R and the capacitor C1, and during charging of the capacitor C1 this input changes state when the time delay duration has elapsed. Accordingly, if the shunt relay $RT_n$ is still closed when the time delay has elapsed, the output S of the logic integrated circuit commands opening of the relay RS.

The logic integrated circuit CIL can advantageously be implemented using a PAL circuit, for example. PAL circuits operate at 12 volts and are used to produce logic operators between input channels and output channels at low cost. They are permanently configured by "burning" them electrically.

More particularly, the relay RS is closed if it is supplied with power by the output S and open otherwise, so that a malfunction of the circuit CE triggers opening of the relay RS. Thus in the event of a fault in the electronic circuit, the time delay duration tends toward zero, in order to open the safety chain instantaneously in this situation. This feature further improves the safety of operation of the time delay management system.

In a different embodiment of the invention, the various electronic circuits and the various relays are grouped together in a chamber containing supports in the form of printed circuit boards, to which they are soldered. This kind of chamber contains one or more printed circuits on which the relays forming the electromagnetic chain are mounted, with the result that the relays are not interconnected by hardwired logic but by conductive tracks of the printed circuits. The circuits can thus form a compact assembly contained in a chamber that may be sealed to prevent an operative modifying its configuration. A plurality of circuits are advantageously plugged into connectors on a backplane card also equipped with connectors providing the electrical connection to the sensors and to the actuators.

Starting up the above kind of boiler is subject to a sequence that also involves time delays. For example, the burner must not be lit before completion of preliminary scavenging of the combustion chamber to evacuate any residual gases before the boiler is started up. Opening of the solenoid valve supplying gas to the burner must be prevented until the preliminary scavenging sequence has finished. This kind of start-up sequence is handled by an automatic controller which controls the preliminary scavenging sequence to command the closing of a relay of the electrical power supply circuit of the gas supply solenoid valve at the end of the preliminary scavenging sequence.

Closing of this relay is commanded only after the minimum time delay duration corresponding to the preliminary scavenging has elapsed. The automatic controller can be a microprocessor-based programmable automatic controller or a "black box" containing a servomotor for controlling the sequence, for example.

Figure 4:
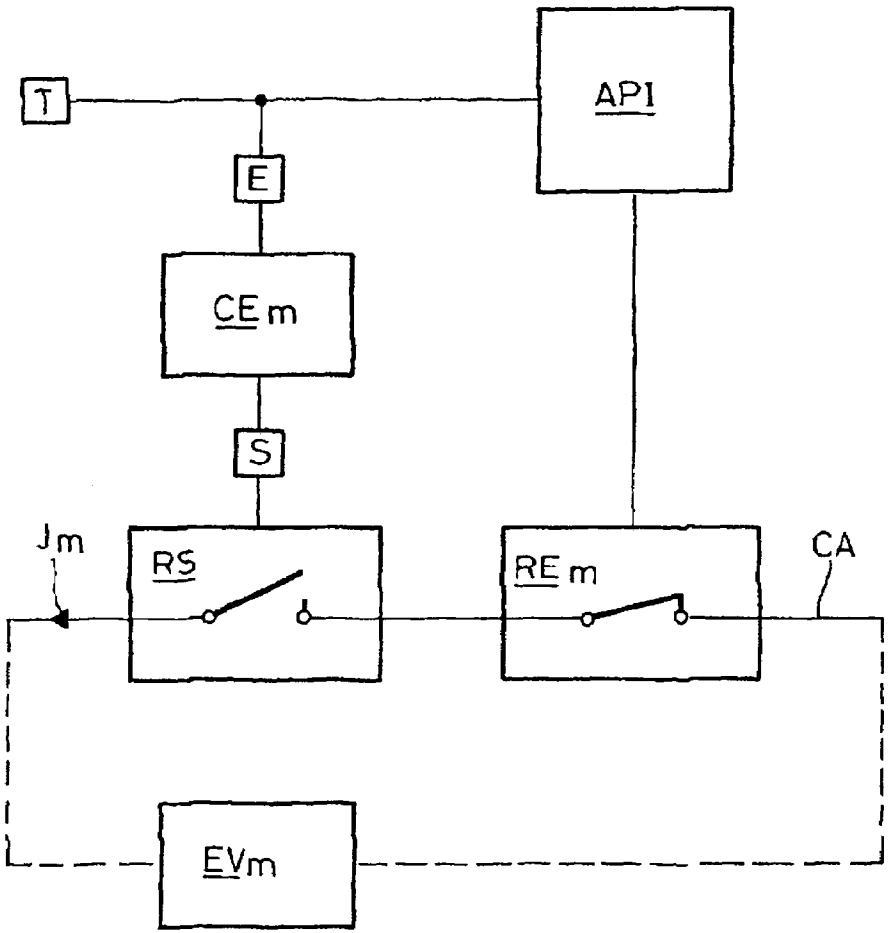
FIG. 4 is a highly diagrammatic depiction of a second embodiment of the invention.

In a similar way to securing the safety chain, the device of the invention can have time delays in its start-up sequence secured by one or more electronic circuits. For management of the preliminary scavenging time delay, the automatic controller API depicted in FIG. 4 manages a time delay which in this instance is a minimum duration that must elapse before it commands closure of a relay $RE_m$ of an electromechanical chain CA. The chain CA that is secured here is an electrical power supply circuit of an actuator $EV_m$ which is the burner gas supply solenoid valve, for example.

According to the invention, the instruction to start the preliminary scavenging time delay that is received at T is sent in parallel in the automatic controller API and an electronic circuit $CE_m$. On receiving an instruction to start the time delay, the electronic circuit $CE_m$ commands the opening of another electromechanical relay RS for the minimum duration. Consequently, in the event of a malfunction of the automatic controller causing premature closing of the relay $RE_m$, the actuator $EV_m$ is no longer supplied with power since the power supply circuit CA is held open by the relay RS that is controlled by the electronic circuit $CE_m$. Here the relay RS constitutes a start-up authorization relay.

More generally, the start-up sequence includes time delays that constitute minimum durations and maximum durations for which relays must be operated. Securing the whole of a start-up sequence of this kind therefore involves using a plurality of electronic circuits to manage the two types of time delay of the automatic controller in parallel.

The electronic circuit $CE_m$ managing this preliminary scavenging time delay, which is a minimum duration, can be a circuit of the type depicted in FIG. 3, for example, but controlled by logic different from that described above. This circuit holds the start-up authorization relay RS open on receiving a time delay instruction and commands closing of this relay after the time delay duration has elapsed.

More particularly, the relay RS is closed when it is supplied with power by the output S and open otherwise, so that a malfunction of the circuit CE triggers opening of the relay RS. Thus in the event of a fault in the electronic circuit, the time delay duration tends toward infinity to prohibit starting of the burner in this situation. This feature further improves the safety of operation of the time delay management system.

Clearly the safety device of the invention provides an improved level of safety of a safety time delay management system by providing heterogeneous redundancy in respect of the management of said time delays.

What is claimed is:

1. A safety device for an industrial boiler (CHA), said device comprising electromechanical relays ($RE_n$, RS) connected in series to form an electromechanical safety chain (CH1) and at least one normally open shunt relay ($RT_n$) that is connected in parallel with one of said electromechanical relays ($RE_n$) and is controlled by an automatic controller (API) so that it is closed for a time delay duration, which device is characterized in that said shunt relay ($RT_n$) has a contact connected to an electronic circuit ($CE_n$) and said electronic circuit ($CE_n$) controls opening of an electromechanical relay (RS) connected in series in the safety chain in the event of closure of said shunt relay ($RT_n$) for a duration exceeding said time delay duration.

2. A safety device for an industrial boiler (CHA), said device comprising electromechanical relays ($RE_m$, RS) connected in series to form an electrical power supply circuit (CA) of an actuator ($EV_m$) of the boiler and one of said relays ($RE_m$) being controlled by an automatic controller so that it is open for a time delay duration on receiving a time delay start instruction, which device is characterized in that an electronic circuit ($CE_m$) controls another electromechanical relay (RS) that is also connected in series in said power supply circuit (CA) and opens said other electromechanical relay (RS) for said time delay duration immediately on receiving said time delay start instruction.

3. The device according to claim 1, wherein said relay (RS) that is controlled by the electronic circuit ($CE_n$) is closed when it is supplied with electrical power by the electronic circuit and open otherwise.

4. The safety device according to claim 1, wherein said relays and said electronic circuit are mounted on a support in the form of a printed circuit board.

* * * * *